US012735836B2

(12) United States Patent
Mok et al.

(10) Patent No.: US 12,735,836 B2
(45) Date of Patent: Sep. 15, 2026

(54) NONWOVEN FIBROUS WEB

(71) Applicant: 3M INNOVATIVE PROPERTIES COMPANY, St. Paul, MN (US)

(72) Inventors: Michelle M. Mok, St. Paul, MN (US); Michael R. Berrigan, Oakdale, MN (US); Aniruddha A. Upadhye, St. Paul, MN (US); Andrew W. Vail, Bayport, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 670 days.

(21) Appl. No.: 18/044,713

(22) PCT Filed: Sep. 9, 2021

(86) PCT No.: PCT/IB2021/058202
§ 371 (c)(1),
(2) Date: Mar. 9, 2023

(87) PCT Pub. No.: WO2022/058848
PCT Pub. Date: Mar. 24, 2022

(65) Prior Publication Data

US 2024/0003077 A1 Jan. 4, 2024

Related U.S. Application Data

(60) Provisional application No. 63/079,111, filed on Sep. 16, 2020.

(51) Int. Cl.
*D06M 10/00* (2006.01)
*D04H 1/435* (2012.01)
(Continued)

(52) U.S. Cl.
CPC ..... *D06M 10/001* (2013.01); *D04H 1/435* (2013.01); *D04H 1/4391* (2013.01);
(Continued)

(58) Field of Classification Search
CPC ..... D06M 10/001; D06M 10/005; D06M 3300/00; D04H 1/435; D04H 1/011;
(Continued)

(56) References Cited

U.S. PATENT DOCUMENTS 4,868,006 A 9/1989 Yorkgitis et al.
10,087,405 B2 10/2018 Swanson et al.
(Continued)

FOREIGN PATENT DOCUMENTS

JP H04-353529 A 12/1992
KR 20140074758 A 6/2014
(Continued)

OTHER PUBLICATIONS

Espacenet translation of WO-2014135539-A1. (Year: 2014).*
(Continued)

*Primary Examiner* — Marla D Mcconnell
*Assistant Examiner* — Christine X Nisula
(74) *Attorney, Agent, or Firm* — Lynn R. Hunsberger; Jonathan V. Sry

(57) ABSTRACT

A fibrous web comprising multiple fibers, wherein the fibrous web has a major web surface; wherein the fibers near the major web surface comprise an outer surface; wherein the outer surface of the fibers compromises a recrystallized skin layer; wherein the recrystallized skin layer has a plurality of textures; and wherein at least another part of the outer surface is smooth.

14 Claims, 4 Drawing Sheets

(51) Int. Cl.

| | |
|---|---|
| ***D04H 1/4391*** | (2012.01) |
| ***D04H 3/011*** | (2012.01) |
| ***D04H 3/018*** | (2012.01) |
| ***D06B 9/00*** | (2006.01) |
| ***D06M 101/32*** | (2006.01) |

(52) U.S. Cl.
CPC ..... *D04H 3/011* (2013.01); *D04H 3/018* (2013.01); *D06B 9/00* (2013.01); *D06M 2101/32* (2013.01); *D06M 2200/00* (2013.01); *D10B 2503/00* (2013.01)

(58) Field of Classification Search
CPC ..... D06B 9/00; D02J 1/00; D02J 1/06; B29C 59/16; Y10T 428/2976; Y10T 428/298
See application file for complete search history.

(56) References Cited

U.S. PATENT DOCUMENTS

2007/0264568 A1* 11/2007 Ryu ..... H01M 4/621 429/213
2014/0083066 A1* 3/2014 Bahukudumbi .... B29C 71/0009 264/48
2014/0275692 A1* 9/2014 Patel ..... B01D 39/1623 585/818
2022/0347602 A1* 11/2022 Wells ..... B01D 46/62

FOREIGN PATENT DOCUMENTS

WO 1999016964 A1 4/1999
WO WO-2014135539 A1 * 9/2014 ..... B29C 71/02
WO 2021255539 A1 12/2021

OTHER PUBLICATIONS

Chung, "Novel Scaffold Design with Multi-Grooved PLA Fibers", Biomedical Materials, 2011, vol. 6, pp. 045001/1-045001/12.
International Search Report for PCT Application No. PCT/IB2021/058202, mailed on Jan. 3, 2022, 4 pages.
Tian, "Formation of Highly Porous Structure in The Electrospun Polylactide Fibers by Swelling—Crystallization in Poor Solvents", RSC Advances, 2015, vol. 5, pp. 37539-37544.

* cited by examiner

PE 1 - NO SOLVENT

EX 1A - ACETONE

EX 1B - THF

EX 1C - 50/50 ACETONE/THF

NONWOVEN FIBROUS WEB

CROSS REFERENCE TO RELATED APPLICATIONS

This application is a national stage filing under 35 U.S.C. 371 of PCT/IB2021/058202, filed Sep. 9, 2021, which claims the benefit of U.S. Provisional Patent Application No. 63/079,111, filed Sep. 16, 2020, the disclosure of which is incorporated by reference in its/their entirety herein.

BACKGROUND

Polymer fibrous webs are useful in a variety of products including medical and hygiene products, carpets and floor coverings, apparel and household textiles, filtering media, agro- and geotextiles, automotive interior, filler for sleeping bags, comforters, pillows, and cushions, cleaning wipes, abrasive articles, and numerous others. There is a need for better fibrous web.

SUMMARY

Thus, in one aspect, the present disclosure provides a fibrous web comprising multiple fibers, wherein the fibrous web has a major web surface; wherein the fibers near the major web surface comprise an outer surface; wherein the outer surface of the fibers compromises a recrystallized skin layer; wherein the recrystallized skin layer has a plurality of textures; and wherein at least another part of the outer surface is smooth.

In another aspect, the present disclosure provides a method, the method comprising: providing a fiber having an outer surface; exposing the outer surface to a pulsed ultraviolet flashlamp radiation to prime the outer surface; and exposing the fiber to a solvent to create a recrystallized skin layer on the outer surface.

Various aspects and advantages of exemplary embodiments of the present disclosure have been summarized. The above Summary is not intended to describe each illustrated embodiment or every implementation of the present disclosure. Further features and advantages are disclosed in the embodiments that follow. The Drawings and the Detailed Description that follow more particularly exemplify certain embodiments using the principles disclosed herein.

Definitions

For the following defined terms, these definitions shall be applied for the entire Specification, including the claims, unless a different definition is provided in the claims or elsewhere in the Specification based upon a specific reference to a modification of a term used in the following definitions:

The terms "about" or "approximately" with reference to a numerical value or a shape means+/−five percent of the numerical value or property or characteristic, but also expressly includes any narrow range within the +/−five percent of the numerical value or property or characteristic as well as the exact numerical value. For example, a temperature of "about" 100° C. refers to a temperature from 95° C. to 105° C., but also expressly includes any narrower range of temperature or even a single temperature within that range, including, for example, a temperature of exactly 100° C. For example, a viscosity of "about" 1 Pa-sec refers to a viscosity from 0.95 to 1.05 Pa-sec, but also expressly includes a viscosity of exactly 1 Pa-sec. Similarly, a perimeter that is "substantially square" is intended to describe a geometric shape having four lateral edges in which each lateral edge has a length which is from 95% to 105% of the length of any other lateral edge, but which also includes a geometric shape in which each lateral edge has exactly the same length.

The term "substantially" with reference to a property or characteristic means that the property or characteristic is exhibited to a greater extent than the opposite of that property or characteristic is exhibited. For example, a substrate that is "substantially" transparent refers to a substrate that transmits more radiation (e.g. visible light) than it fails to transmit (e.g. absorbs and reflects). Thus, a substrate that transmits more than 50% of the visible light incident upon its surface is substantially transparent, but a substrate that transmits 50% or less of the visible light incident upon its surface is not substantially transparent.

The terms "a", "an", and "the" include plural referents unless the content clearly dictates otherwise. Thus, for example, reference to a material containing "a compound" includes a mixture of two or more compounds.

BRIEF DESCRIPTION OF THE DRAWINGS

The disclosure may be more completely understood in consideration of the following detailed description of various embodiments of the disclosure in connection with the accompanying figures, in which.

While the above-identified drawings, which may not be drawn to scale, set forth various embodiments of the present disclosure, other embodiments are also contemplated, as noted in the Detailed Description. In all cases, this disclosure describes the presently disclosed invention by way of representation of exemplary embodiments and not by express limitations. It should be understood that numerous other modifications and embodiments can be devised by those skilled in the art, which fall within the scope and spirit of this disclosure.

DETAILED DESCRIPTION

Before any embodiments of the present disclosure are explained in detail, it is understood that the invention is not limited in its application to the details of use, construction, and the arrangement of components set forth in the following description. The invention is capable of other embodiments and of being practiced or of being carried out in various ways that will become apparent to a person of ordinary skill in the art upon reading the present disclosure. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. It is understood that other embodiments may be utilized and structural or logical changes may be made without departing from the scope of the present disclosure.

As used in this Specification, the recitation of numerical ranges by endpoints includes all numbers subsumed within that range (e.g. 1 to 5 includes 1, 1.5, 2, 2.75, 3, 3.8, 4, and 5, and the like).

Unless otherwise indicated, all numbers expressing quantities or ingredients, measurement of properties and so forth used in the Specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Figure 1:
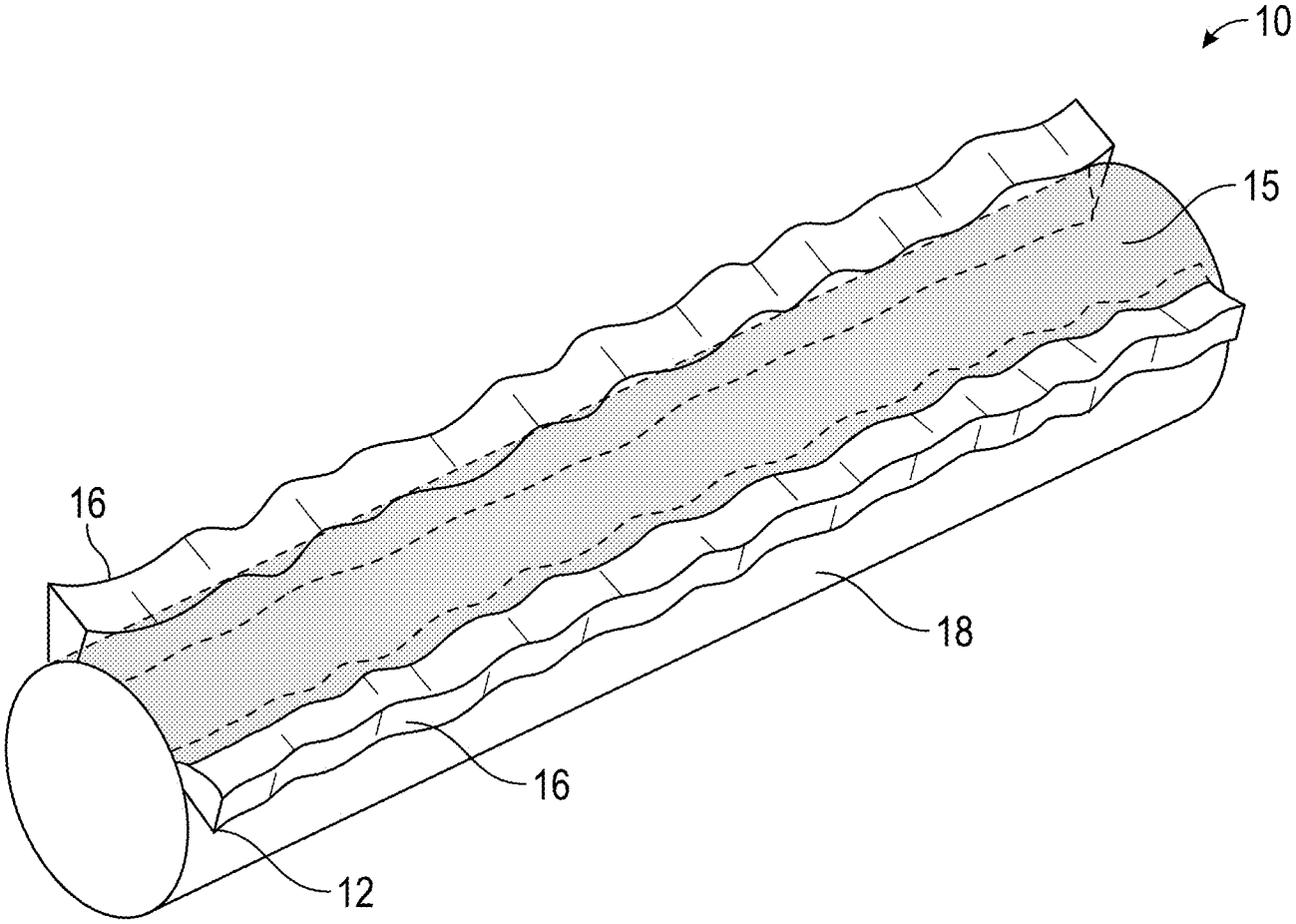
FIG. 1 is a perspective view of a fiber according to an embodiment.
Figure 2A:
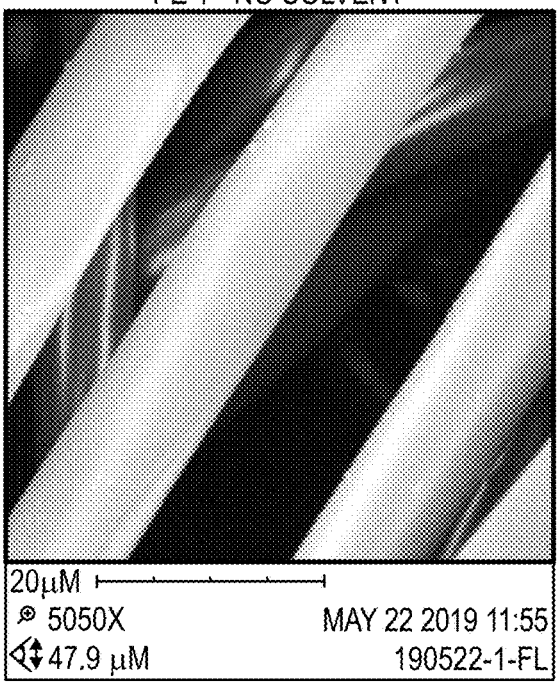
FIGS. 2A-D are SEM images of fibers of the current application.
Figure 2B:
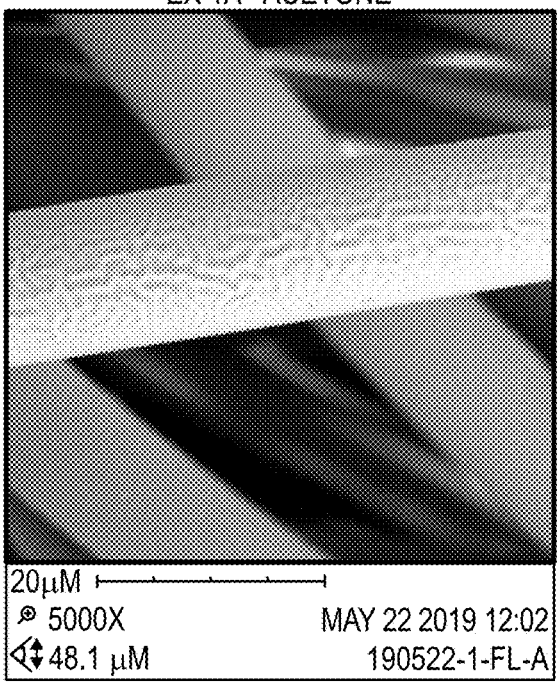
Figure 2C:
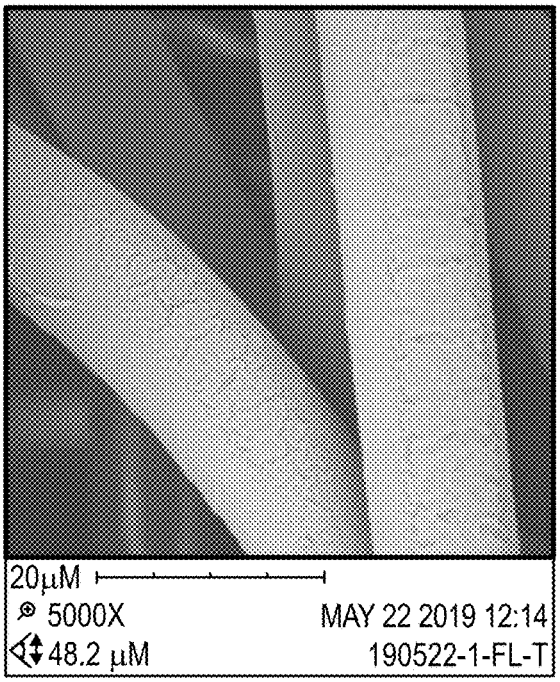
Figure 2D:
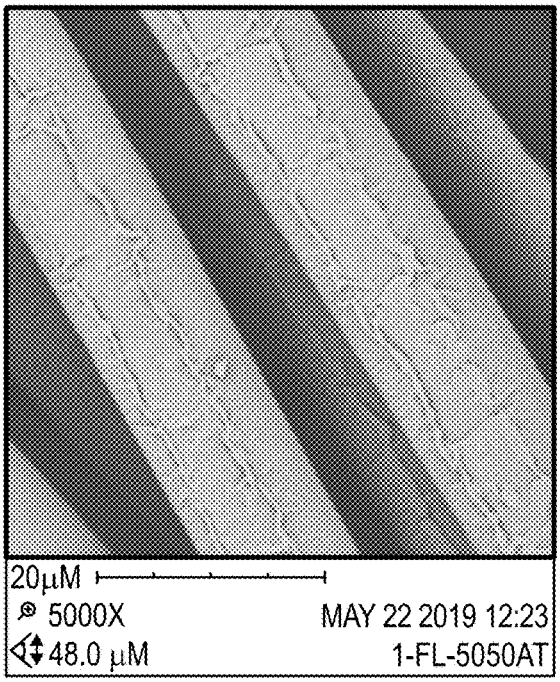
Figure 3A:
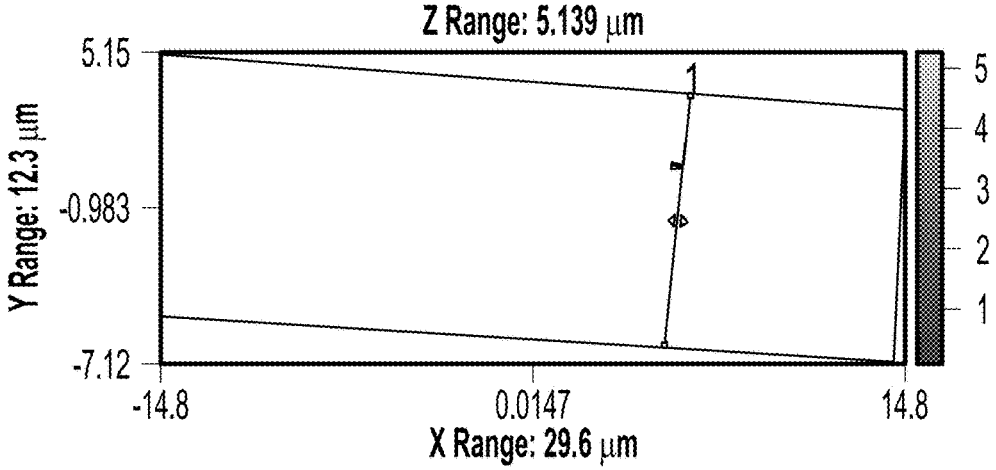
FIGS. 3A-D are Line profiles of Ex. 1C.
Figure 3B:
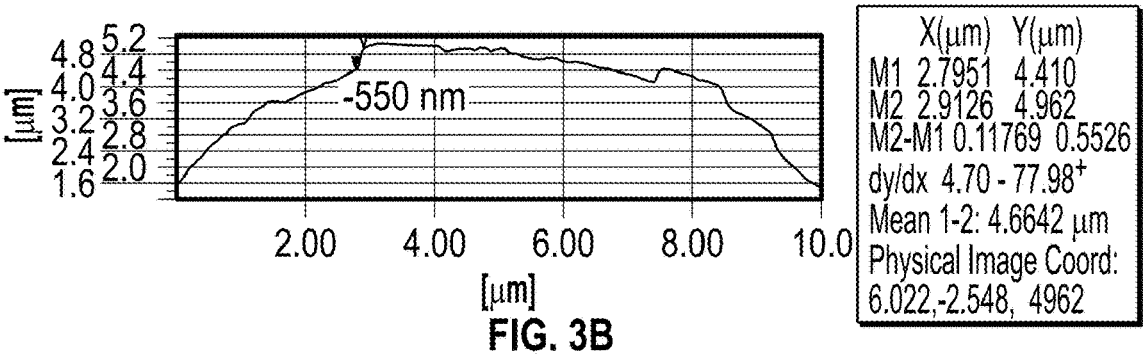
Figure 3C:
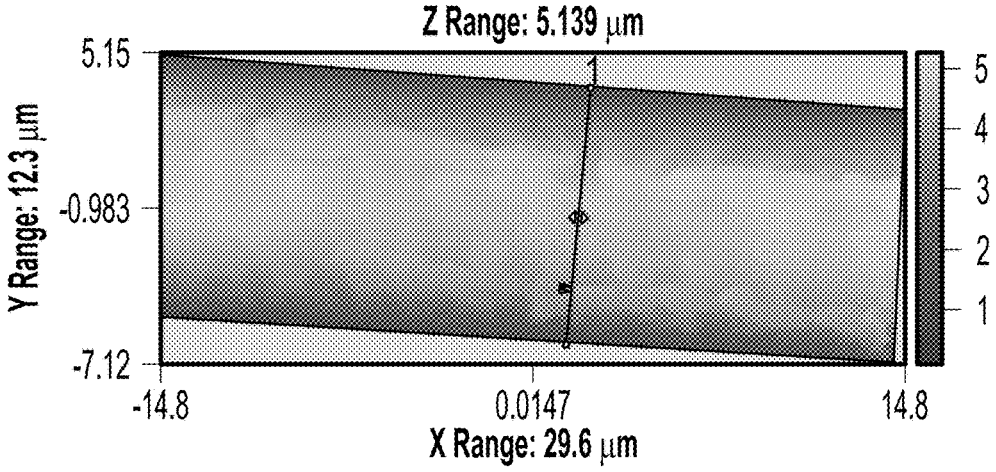
Figure 3D:
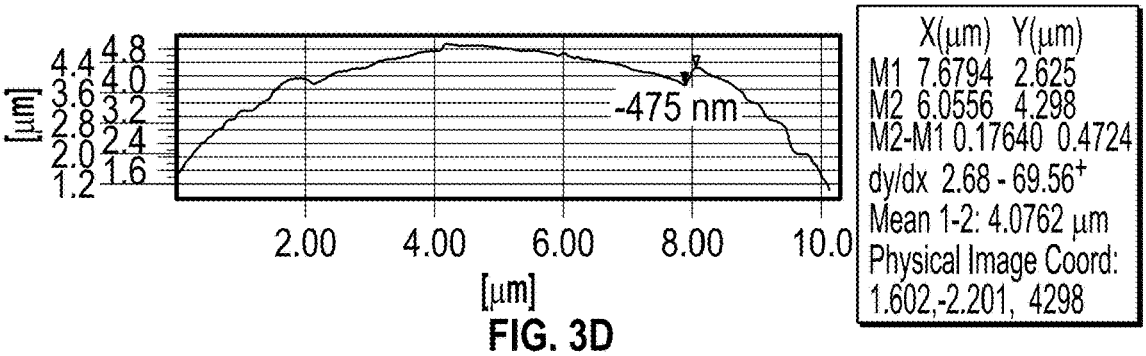
Figure 4A:
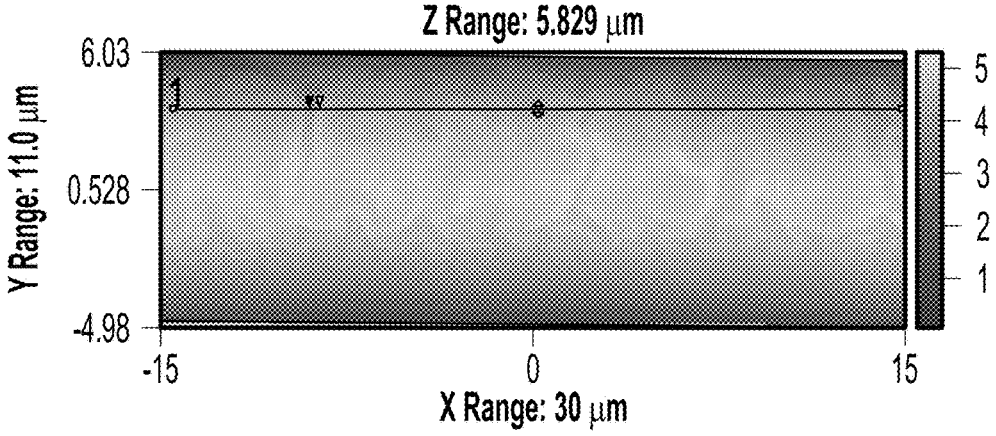
FIGS. 4A-D are Line profiles of Ex. 1B.
Figure 4B:
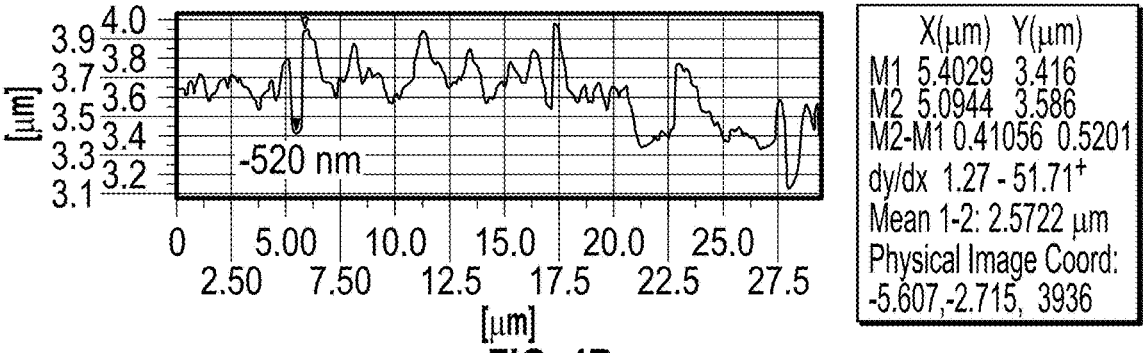
Figure 4C:
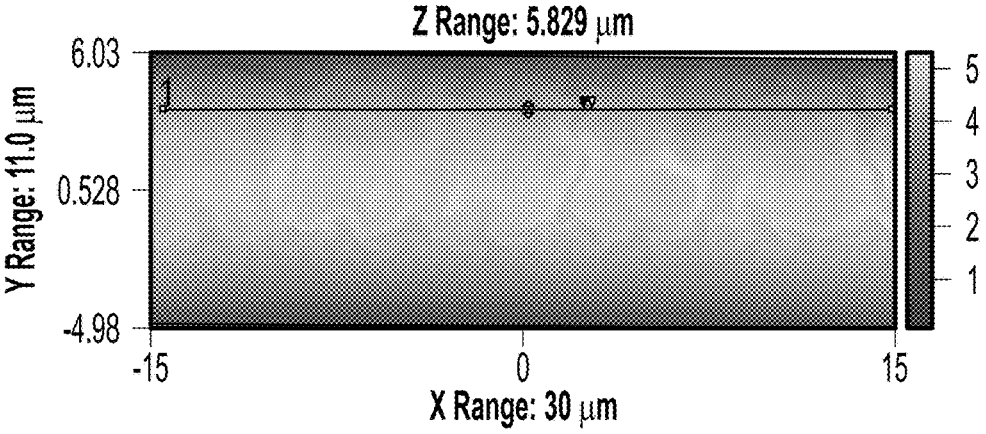
Figure 4D:
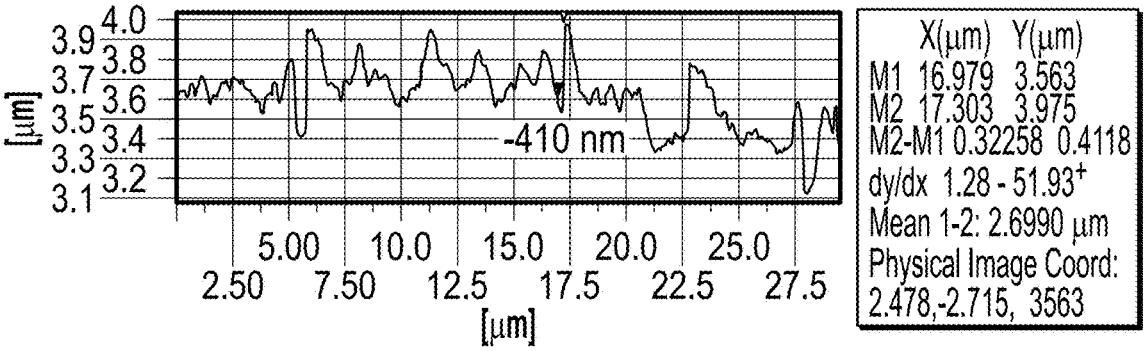

One embodiment of a fiber according to the present disclosure is shown in FIG. 1. FIG. 1 illustrates a fiber 10 having a generally irregular cross-section. In the illustrated embodiment, the fiber 10 can include an outer surface 12. The outer surface 12 can include a recrystallized skin layer 15. The recrystallized skin layer 15 can have a plurality of textures or protrusions 16. These textures or protrusions may be randomly oriented, or roughly aligned with the fiber orientation. At least another part 18 of the outer surface 12 is smooth. In some embodiments, plurality of textures or protrusions 16 can be on one side of the fiber 10.

The recrystallized skin layer can be recrystallized from a melted skin layer after exposure to ultra-violet light, for polymers capable of absorbing in the UV range, such as polyethylene terephthalate. Without wishing to be bound by theory, it is believed that the UV flashlamp irradiation process is especially effective in creating this melted skin layer.

During the fiber melt spinning process, the polymer fibers have the opportunity to partially recrystallize from the molten state, depending on the material and spinning conditions. Upon irradiation of the fiber with UV flashlamp, fibers made from polyethylene terephthalate can absorb enough energy such that the local temperature increases beyond the polymer melt temperature. In this case, the crystalline components of the fiber that receive sufficient energy can enter the melt state. The effect on the fiber may be limited to a depth from the surface of 500 nanometers or less, such as 300 nanometers or less, to form a melted skin layer. Following the short burst of energy, the melted skin layer is rapidly cooled, by conduction of heat into the bulk of the material, to below the glass transition temperature of the polymer, trapping the melted skin layer in an amorphous state.

The recrystallized skin layer can be recrystallized from a melted skin layer after exposure to ultra-violet light. For example, the melted skin layer can be immersed in solvent to recrystallize and form a plurality of textures. In some embodiments, the recrystallized skin layer can have a depth extending for 500 nanometers, 300 nanometers, 200 nanometers, 100 nanometers, or 50 nanometers or less. In some embodiments, the plurality of textures can extend into the fibrous web for 500 nanometers, 300 nanometers, 200 nanometers, 100 nanometers, or 50 nanometers or less. In some embodiments, the recrystallized skin layer can have from 10 to 60%, from 20 to 50%, from 20 to 40%, or less than 60%, 50%, 40%, or 30% or more than 10%, 20%, 30%, 40%, or 50% of the outer surface 12.

In some embodiments, the fibers can have a same polymer or copolymer. In some embodiments, the polymer must be both absorptive of the UV wavelength of the flashlamp and solvent responsive. In some embodiments, the fibers can be made from a polymer containing an aromatic ring such as polyethylene terephthalate, polyethylene terephthalate blended with glycol-modified polyethylene terephthalate (PETg), polyethylene naphthalate or polybutylene terephthalate. Polyesters can be made into fibers that have native crystallinity from 4-70% depending on process conditions and polymer alignment.

In some embodiments, fibers according to the present disclosure may have an average surface roughness from 5 to 200 nm, from 10 to 190 nm, from 20 to 180 nm, from 30 to 170 nm, from 50 to 150 nm, or more than 5 nm, 10 nm, 15 nm, 20 nm, 30 nm, 40 nm, 50 nm, 60 nm, 70 nm, 80 nm, 90 nm, 100 nm, 120 nm, 150 nm due to the plurality of textures on the outer surface 12.

Fibers according to the present disclosure may have any desired length. For example, the fibers may have a length of at least 1 mm. In some embodiments, the fibers are considered continuous. In some embodiments, fibers according to the present disclosure may have a length up to 200 mm, 100 mm or 60 mm, in some embodiments, in a range from 2 mm to 60 mm, 3 mm to 40 mm, 2 mm to 30 mm, or 3 mm to 20 mm.

Typically, the fibers disclosed herein have a maximum cross-sectional dimension up to 100 (in some embodiments, up to 50, 40, 15, 10, or 5) micrometers. For example, the fiber may have a oval cross-section with an average diameter less than 50, 40, 20, 15, 10 or 5 micrometers. In some embodiments, the fiber has an irregular cross section. Typically, the fibers disclosed herein have an average diameter more than 1 micrometer.

When the cross-section of the fiber is oval, the width in the length-to-width aspect ratio may be considered the maximum cross-sectional dimension. The length-to-width aspect ratio of fibers according to the present disclosure may be, for example, up to 10:1, 9:1, 8:1, 7:1, 5:1, 4:1, 3:1, 2:1, 1.5:1, 1.3:1, or 1.1:1. In some embodiments, the length-to-width aspect ratio may be in a range from 1.5:1 to 1.1, 1.4:1 to 1:1, 1.3:1 to 1:1, or 1.2:1 to 1:1.

In some embodiments, the recrystallized skin layer of the fiber can be formed using a solvent induced crystallization method. In this approach, one starts with a fiber having an amorphous melted skin layer made of a semicrystalline polymer. While not crystallized, it has the potential for crystallization.

The effective solvent systems will be polymer dependent. Many combinations and ratios of solvent mixtures may be applicable, through choosing solvent mixes to target a Flory-Huggins solvent-polymer interaction parameter ($\chi_{sp}$) which will induce more or less swelling in the polymer. Generally, $\chi_{sp}=V(\delta_s-\delta_p)^2/RT$ where $\delta_s$ and $\delta_p$ are the Hildebrand solvent and polymer solubility parameters, and for a mixed solvent, $\delta_s$ for the mixture is the volume-weighted average of the components. By using a higher fraction of a "good" solvent in the mixture (lower $\chi_{sp}$, or where $\delta_s$ and $\delta_p$ are close), there will be more swelling, to the point of fragmentation or even dissolution in the extreme cases. By using a higher fraction of a "poor" solvent (higher $\chi_{sp}$, or where $\delta_s$ and $\delta_p$ are not close), swelling will be minimal, and the final effect will be solvent-induced crystallization without texturing. By choosing intermediate ratios of solvents, the level of texturing can be tuned. Depending on the situation, a single solvent, a binary system or more than two solvents can be used. The temperature at which the polymer/solvent contact takes place will also influence the susceptibility of the polymer to swelling by a given solvent system.

Some examples of solvents and solvent combinations that can be used for creating the recrystallized skin layer through solvent induced crystallization of polyethylene terephthalate are acetic acid, acetone, chloroform, dichloromethane, dimethylformamide, dimethylsulfoxide, ethanol, ethyl acetate, formic acid, methanol, methyl acetate, tetrahydrofuran, water, n-butanol, acetonitrile, glycerol, n-propanol, trifluoro acetic acid, trichloro acetic acid and combination thereof.

The present disclosure also provides a fibrous web including multiple fibers as described in any of the above embodiments. The fibrous web may be, for example, a knit, woven, flocked or nonwoven web. In some embodiments, the dimensions of the fibers used together in the fibrous web or article according to the present disclosure, and the components making up the fibers, are generally about the same, although use of fibers with even significant differences in compositions and/or dimensions may also be useful.

In some embodiments, the fibrous web is a nonwoven web. In some embodiments, the fibrous web is a spunbonded, meltblown, or spunlace nonwoven. The term "spunbonded" refers to small diameter fibers which are formed by extruding molten thermoplastic material as filaments from a plurality of fine, usually circular, capillaries of a spinneret with the diameter of the extruded filaments then being rapidly reduced to fibers. The fibers are then directly deposited (e.g., using air streams) onto a collecting belt in a random fashion. Spunbond fibers are generally continuous and have diameters generally greater than about 7 micrometers, more particularly, between about 10 and about 20 micrometers. The term "meltblown" means fibers formed by extruding a molten thermoplastic material through a plurality of fine, usually circular, die capillaries as molten threads or filaments into converging high velocity, usually hot, gas (e.g., air) streams which attenuate the filaments of molten thermoplastic material to reduce their diameter, which reduction may be to microfiber diameter. Thereafter, the meltblown fibers are carried by the high velocity gas stream and are deposited on a collecting surface to form a web of randomly disbursed meltblown fibers. Meltblown fibers are generally microfibers which may be continuous or discontinuous with diameters generally less than 10 micrometers. Spunlacing uses high-speed jets of water to strike a web to intermingle the fibers of the web. Spunlacing is also known as hydroentangling and can be carried out on fibrous webs made, for example, using carded webs and air-laid webs. The term "coform" means a meltblown material to which at least one other material (e.g., pulp or staple fibers) is added during the meltblown web formation.

The nonwoven fibrous web may also be made from bonded carded webs. Carded, or gametted, webs are made from separated staple fibers, in which fibers are sent through a combing or carding unit or a garneting unit, which separates and aligns the staple fibers in the machine direction so as to form a generally machine direction-oriented fibrous nonwoven web. However, randomizers can be used to reduce this machine direction orientation. Once the carded web has been formed, it is then bonded by one or more of several bonding methods to give it suitable tensile properties. One bonding method is powder bonding or binder fibers bonding with one or more phases that soften and adhere at a temperature below the melting point of other fibers in the structures, wherein a powdered adhesive or binder fibers are distributed through the web and then activated, usually by heating the web and adhesive with hot air. Another bonding method is pattern bonding wherein heated calender rolls or ultrasonic bonding equipment are used to bond the fibers together, usually in a localized bond pattern though the web can be bonded across its entire surface if so desired. Generally, the more the fibers of a web are bonded together, the greater the tensile properties of the nonwoven web.

The nonwoven fibrous web may also be made using a wet laid or airlaid process. A wet laying or "wetlaid" process comprises (a) forming a dispersion comprising one or more types of fibers, optionally a polymeric binder, and optionally a particle filler(s) in at least one dispersing liquid (preferably water); and (b) removing the dispersing liquid from the dispersion. An "airlaid" or air laying process takes existing fibers and forms them into a non-woven structure using a process in which a wall of air blows fibers onto a perforated collection drum having negative pressure inside the drum. The air is pulled though the drum and the fibers are collected on the outside of the drum where they are removed as a web. Because of the air turbulence, the fibers are not in any ordered orientation and thus can display strength properties that are relatively uniform in all directions.

In some embodiments, one or more additional fiber populations are incorporated into the non-woven fibrous layer. Differences between fiber populations can be based on, for example, composition, median fiber diameter, and/or median fiber length.

The fibrous web according to the present disclosure may have a variety of basis weights, depending on the desired use of the fibrous web. Suitable basis weights for nonwoven fibrous webs according to the present disclosure may be, for example, 500 grams per square meter (gsm) or less, in a range from 7 gsm to 400 gsm, in a range from 10 gsm to 300 gsm, or in a range from 12 gsm to 200 gsm.

A method of making the fiber is provided. The method can include providing a fiber having an outer surface; exposing the outer surface to a pulsed ultra-violet flashlamp radiation to prime the outer surface; and exposing the fiber to a solvent to create a recrystallized skin layer on the outer surface. In some embodiments, the energy absorbed by the outer surface is between about 45 to 2000 mJ/cm$^2$. In some embodiments, the total energy output of the pulsed ultra-violet flashlamp is between about 25 to 200 mJ/cm$^2$ per pulse.

The flashlamp treatment station uses high energy capacitors and a pulse forming network to generate short-pulse broadband light. The flashlamp used has a pulse duration (also referred to as pulse width) of less than 100 μs. It is preferred that the pulse width is about 4 to 5 μs. In the case of a pulsed system, the instantaneous energy deposited on the surface can be orders of magnitude higher compared with a constant value source of similar average power. The high instantaneous energy deposition can result in micromelting of the surface generating the melted layer. The pulse frequency of the flashlamp is not necessarily limited, but can occur at a frequency of about 1 to 30 Hz. With pulse duration of less than 100 μs, and the gap between any two pulses of the flashlamp thus being orders of magnitude longer, the material surface is cooled conductively by the bulk of the material. This reduces the likelihood of cracking which is seen in constant UV source radiation, as the thermal stresses are relieved by this cooling phenomenon. In various embodiments, the pulse duration can be at least 1, 2, 3, 4, 5, 6, 7, 8, 9, 10, 20, 30, 40, 50, or 75 s but less than 100 s. In various embodiments, the pulse duration for the pulsed ultra-violet flashlamp radiation is between about 2 to about 100 μs.

The following working examples are intended to be illustrative of the present disclosure and not limiting.

EXAMPLES

Flashlamp of Fibers

Six polyethylene terephthalate (PET)-based nonwoven samples (C1-C6) were subjected to pulsed ultraviolet (UV)

light using a flashlamp system to create Preparatory Examples PE1-PE6. These are described in Table 1. The flashlamp system included a xenon lamp (obtained under the trade designation "MODEL XP 456" from Applied Photon Technology, Hayward, CA), with a xenon pressure of 200 mTorr (27 Pa), emitting broadband light between wavelengths of 200 nm and 500 nm, with a maximum output near 240 nm. The flashlamp system had a pulse FWHM (full width at half max) of 4.6 μs, and peak power of approximately 30 MW. The materials were treated using a flashlamp at 24 kV voltage across a 25 inch (63.5 cm) lamp and exposure was done in such a way that each area is exposed to ten flashes from the lamp.

TABLE 1

| Preparatory Example | Control Input | Obtained from | Trade Designation | Description |
|---|---|---|---|---|
| PE1 | C1 | Jacob Holm Industries, Candler, NC | "SONTARA 8004" | Hydraulically entangled PET wipe |
| PE2 | C2 | Nonwoven Solutions, now a part of Fibertex Nonwovens, Ingleside, IL | "PE035-027BC" | PET Carded/ Calendared |
| PE3 | C3 | Midwest Filtration LLC, Cincinnati, OH | "UNITHERM 170 HK" | PET/PE Bicomponent Spunbond/ Thermal bond |
| PE4 | C4 | Kolon Industries, Seoul, South Korea | "FINON C130 NW" | PET Spunbond |
| PE5 | C5 | Midwest Filtration LLC, Cincinnati, OH | "UNIPOLY 75 MRF" | PET Spunbond |
| PE6 | C6 | Avintiv Fiberweb Technical Nonwovens, Old Hickory, TN | "REEMAY 2100" | PET Spunbond |

Solvent Treatment of Flashlamped Fibers

Following the flashlamp process, the samples were immersed in solvent for at least 1 minute at room temperature. Solvent systems used were acetone (Exs. 1A-3A), tetrahydrofuran (THF) (Exs. 1B-6B), and 50/50 v/v acetone/THF (Exs. 1C-6C).

The surfaces of the fibers before and after the treatment were examined using a scanning electron microscope (SEM) (obtained under the trade designation "FEI PHENOM"; a model believed to be equivalent is presently available under the trade designation "PHENOM G1" from NanoScience Instruments, Phoenix, AZ). A thin layer of gold was sputter coated on the samples to make them conductive. SEM instrument conditions included accelerating voltage of 5.0 KV and working distance of 2.0 mm to 11.5 mm. The appearances of the fiber surfaces are recorded in Table 2.

TABLE 2

| Example | Input | Treatment | Fiber Surface Appearance under SEM |
|---|---|---|---|
| 1A | PEI | Acetone | Lightly wrinkled |
| 2A | PE2 | Acetone | Lightly wrinkled |
| 3A | PE3 | Acetone | No change observed |
| 1B | PE1 | THF | Wrinkles |
| 2B | PE2 | THF | Ridged wrinkles |
| 3B | PE3 | THF | Ridged wrinkles |
| 4B | PE4 | THF | Ridged wrinkles |
| 5B | PE5 | THF | Ridged wrinkles |
| 6B | PE6 | THF | Ridged wrinkles |

TABLE 2-continued

| Example | Input | Treatment | Fiber Surface Appearance under SEM |
|---|---|---|---|
| 1C | PE1 | 50/50 Acetone/THF | Ridged wrinkles |
| 2C | PE2 | 50/50 Acetone/THF | Ridged wrinkles |
| 3C | PE3 | 50/50 Acetone/THF | Ridged wrinkles |
| 4C | PE4 | 50/50 Acetone/THF | Ridged wrinkles |
| 5C | PE5 | 50/50 Acetone/THF | Ridged wrinkles |
| 6C | PE6 | 50/50 Acetone/THF | Ridged wrinkles |

Prior to treatment, the fiber surfaces were smooth and evenly rounded. A change in topography was observed at the surface of the fiber which was within the line of sight of the flashlamp radiation. This was generally about one-sixth to one-quarter of the outward facing surface area along each outer fiber, effectively leaving a strip of rougher surface along the fiber. The acetone treatment generally gave the least pronounced roughness, while THF and acetone/THF treatments gave more obvious wrinkles, many with ridges. An example set of SEM images is shown in FIG. 2 for the SONTARA 8004 material before (PE1—FIG. 2A) and after (Ex. 1A—FIG. 2B, Ex. 1B—FIG. 2C, and Ex. 1C—FIG. 2D) solvent treatment.

AFM Evaluation of Surface Roughness

Tapping Mode atomic force microscopy (AFM) was performed using an AFM microscope (obtained under the trade designation "DIMENSION FASTSCAN" from Bruker Nano Inc., Santa Barbara, CA), with silicon cantilever tips with an aluminum backside coating (obtained under the trade designation "OTESPA-R3" from Bruker Nano Inc., Santa Barbara, CA), with a nominal resonant frequency of 300 kHz, spring constant of 40 N/m, and tip radius of 7 nm. The tapping amplitude setpoint is typically 85% of the free air amplitude. All AFM measurements were performed under ambient conditions. An offline data processing software (obtained under the trade designation "NANOSCOPE ANALYSIS V1.7" from Bruker Nano Inc.) was used for image processing and analysis. Images were applied with 0th order flatten (to remove z-offsets) and a 2nd order plane fit (to remove bow).

To quantify the roughness presented by the SONTARA 8004 control (C1) and treated fiber (Exs. 1A, 1B and 1C) surfaces, tapping mode AFM was employed to scan over three 5 micron×5 micron areas. From these scans, Rq (root mean square roughness) and Ra (roughness average) were calculated, and results are shown in Table 3. For the control sample, Rq and Ra were both less than 20 nm. With treatment, Rq was measured to be as high as 98 nm (Ex. 1C) and Ra was measured to be as high as 66 nm (Ex. 1B).

TABLE 3

| Sample | Control | | Ex. 1A | | Ex. 1B | | Ex. 1C | |
|---|---|---|---|---|---|---|---|---|
| Measurement | Rq (nm) | Ra (nm) | Rq (nm) | Ra (nm) | Rq (nm) | Ra (nm) | Rq (nm) | Ra (nm) |
| Mean | 19 | 14 | 52 | 39 | 85 | 66 | 98 | 62 |
| St. Dev. | 14 | 10 | 8 | 6 | 23 | 19 | 10 | 17 |

In another approach to quantify the change in topography using AFM, line profiles of individual fibers were captured. SEM (obtained under the trade designation "JSM-6010LA INTOUCHSCOPE" from JEOL Ltd., Tokyo, Japan) was first utilized to locate individual fibers positioned with the roughened side up. Individual fibers were isolated with a pair of tweezers under an optical stereomicroscope and placed on a piece of carbon tape on an SEM sample holder. The isolated fibers were sputtered with a thin layer of Au—Pt alloy for SEM analysis. Individual fibers were analyzed with SEM at different magnifications for the purpose of relocating the same fibers using the optical microscope integrated in the AFM instrument. The fibers were then analyzed with AFM in the same locations analyzed with SEM. Commercial software (obtained under the trade designation "SPIP 6.7.7" from Image Metrology, Horsholm, Denmark) was used for image processing. First, atilt correction was applied manually using the Interactive Tilt tool. Then the Area of Interest tool was used to crop the image to the fiber portion only. No additional image corrections were made in order to preserve the fiber topography.

Line profiles were used to capture exemplary sizes for the larger scale features, as shown in FIG. 3 for Ex. 1C and FIG. 4 for Ex. 1B. In the Figs., the line profile corresponds to the topography traced by the straight line on the AFM image. For Ex. 1B, features on the order of 400-600 nm were measured along the axis of the fiber. For Ex. 1C, features on the order of 400-600 nm were measured along the circumference of the fiber.

Evaluation of Treated Materials as Wines for *C. sporogenes* Spores

Sheets of C1 and Ex. 1C were used to evaluate their efficacy in removing and reducing transfer of *C. sporogenes* spores using the wipe device and procedure from "Test Method for Removal of Microorganisms from Microorganism-contaminated surface and Transfer Contamination" found in U.S. Pat. No. 10,087,405 (Swanson et al.) with minor modifications. For this experiment, the nonwoven was used to wipe a stainless-steel surface with dried inoculum of bacterial spores in a soil matrix. A 4-times loading weight (4.0-times the weight of the dry wipe) was used, instead a 3.5-times (U.S. Pat. No. 10,087,405, Col. 33, Line 41), to prewet the wipes. A prewetted nonwoven was loaded with quaternary ammonium disinfectant cleaner (obtained under the trade designation "3M DISINFECTANT CLEANER RCT CONCENTRATE 40A" from 3M, St. Paul, MN) instead of water (U.S. Pat. No. 10,087,405, Col. 33, Line 41), and attached to a mechanical wiping device (U.S. Pat. No. 10,087,405, Col. 33, Line 48) for wiping surfaces. The spore-contaminated surface was wiped for 15 sec. at 100 rpm and investigated for removal of spores from the surface. The amount of bacterial "spores removed from the surface" were calculated according to U.S. Pat. No. 10,087,405, Col. 34, Line 15 and reported in Table 4.

Following the removal test, the transfer contamination test was performed. The same wipe from the removal test, now contaminated with bacteria, was used on a clean stainless-steel plate to evaluate the "spores transferred from the contaminated wipe to another surface". The percent of spores transferred were calculated according to U.S. Pat. No. 10,087,405, Col. 34, Line 42 and reported in Table 4. The "number of spores transferred" was the number of spores recovered from the previously clean surface.

Ex. 1C had slightly better removal properties than the untreated C1 but was not significantly different based on a t-test, as shown in Table 4. However, Ex. 1C was found to be significantly better at reducing transfer of microbes to a clean surface, showing 43% fewer spores transferred to a clean surface than the unmodified C1.

TABLE 4

| Wipe Sample | Spores removed from the surface (Log Reduction Value) | Spores transferred from the contaminated wipe to another clean surface (% transferred) |
|---|---|---|
| C1 | 2.16 (0.01) | 0.184 |
| Ex. 1C | 2.54 (0.19) | 0.105 |

All references and publications cited herein are expressly incorporated herein by reference in their entirety into this disclosure. Illustrative embodiments of this invention are discussed and reference has been made to possible variations within the scope of this invention. For example, features depicted in connection with one illustrative embodiment may be used in connection with other embodiments of the invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A fibrous web comprising multiple fibers, wherein the fibrous web has a major web surface;

wherein the fibers near the major web surface comprise an outer surface, the fibers comprising at least one of polyethylene terephthalate, polyethylene terephthalate blended with glycol-modified polyethylene terephthalate, polybutylene terephthalate, polyethylene naphthalate, or mixture thereof;

wherein the outer surface of the fibers compromises a recrystallized skin layer;

wherein the recrystallized skin layer has a plurality of textures; and wherein at least another part of the outer surface is smooth.

2. The fibrous web of claim 1, wherein the recrystallized skin layer is recrystallized from a melted skin layer after exposure to ultra-violet light.

3. The fibrous web of claim 1, wherein the fibers have an average surface roughness from 5 to 200 nm.

4. The fibrous web of claim 1, wherein the recrystallized skin layer has a depth and the depth extends for 500 nanometers or less.

5. The fibrous web of claim 1, wherein the plurality of textures extends into the fibrous web for 500 nanometers or less.

6. The fibrous web of claim 1, wherein the recrystallized skin layer comprises 10-60% of the outer surface.

7. The fibrous web of claim 1, wherein the fibers comprise a same polymer.

8. The fibrous web of claim 1, wherein the fibers have a diameter less than 100 μm.

9. The fibrous web of claim 1, wherein the fibers have an irregular cross section.

10. The fibrous web of claim 1, wherein the fibrous web is a nonwoven, woven, knitted or flocked web.

11. A method, the method comprising:

producing a fibrous web comprising multiple fibers having an outer surface, the fibers comprising at least one of polyethylene terephthalate, polyethylene terephthalate blended with glycol-modified polyethylene terephthalate, polybutylene terephthalate, polyethylene naphthalate, or mixtures thereof;

exposing the outer surface of a pulsed ultraviolet flash-lamp radiation to prime the outer surface of the fibers; and exposing the fibers to a solvent to create a recrystallized skin layer on the outer surface, wherein the recrystallized skin layer has a plurality of textures and wherein at least another part of the outer surface is smooth.

12. The method of claim 11, wherein the energy absorbed by the outer surface is between about 45 to 2000 $mJ/cm^2$.

13. The method of claim 11, wherein a pulse duration for the pulsed ultra-violet flashlamp radiation is between about 2 to about 100 μs.

14. The method of claim 11, wherein the total energy output of the pulsed ultra-violet flashlamp is between about 25 to 200 $mJ/cm^2$ per pulse.

* * * * *